US010798977B1

(12) United States Patent
Ransom

(10) Patent No.: US 10,798,977 B1
(45) Date of Patent: Oct. 13, 2020

(54) BRASIERRE WITH INTEGRATED HOLSTER

(71) Applicant: Valory Sheppard Ransom, Pinebluff, NC (US)

(72) Inventor: Valory Sheppard Ransom, Pinebluff, NC (US)

( * ) Notice: Subject to any disclaimer, the term of this patent is extended or adjusted under 35 U.S.C. 154(b) by 0 days.

(21) Appl. No.: 16/133,762

(22) Filed: Sep. 18, 2018

(51) Int. Cl.
*A41C 3/00* (2006.01)
*A41D 27/20* (2006.01)
*F41C 33/04* (2006.01)

(52) U.S. Cl.
CPC ..... *A41C 3/0035* (2013.01); *A41D 27/204* (2013.01); *F41C 33/048* (2013.01)

(58) Field of Classification Search
CPC ..... A41C 3/0035; F41C 33/048
USPC ..... 450/89
See application file for complete search history.

(56) References Cited

U.S. PATENT DOCUMENTS 2,436,430 A * 2/1948 Hart ..... A41C 3/0035 450/3
2,503,847 A * 4/1950 Shanahan ..... A41C 3/0035 450/89
5,832,536 A * 11/1998 Kramer ..... A41B 9/06 2/69
6,176,761 B1 * 1/2001 Underhill ..... A41C 3/0014 450/1
6,517,410 B1 * 2/2003 Underhill ..... A41C 3/0035 450/1
7,631,368 B1 12/2009 Samson
7,743,430 B2 6/2010 Jennings
8,332,967 B2 12/2012 Echikson
D696,487 S 12/2013 Kurmanow
8,839,464 B2 9/2014 French
9,060,550 B2 * 6/2015 Conrad ..... A41C 3/0057
9,295,288 B1 * 3/2016 Goff ..... A41C 3/0035
9,526,284 B2 12/2016 Graves
9,557,139 B1 1/2017 Milner
9,826,784 B1 * 11/2017 Cutrona ..... A41C 3/0035
2002/0062512 A1 * 5/2002 Gustafson ..... A41B 9/08 2/118
2005/0235398 A1 10/2005 Yoo
2006/0121826 A1 * 6/2006 Nazzaro ..... A41C 3/0035 450/89
2008/0032600 A1 * 2/2008 Updyke ..... A41C 3/0035 450/89
2009/0209173 A1 * 8/2009 Arledge ..... A41C 3/0035 450/39
2012/0064799 A1 * 3/2012 Rivers ..... A41C 3/0035 450/86
2013/0288569 A1 * 10/2013 Gentry ..... A41C 3/0035 450/86

(Continued)

FOREIGN PATENT DOCUMENTS

WO 2016054386 4/2016

*Primary Examiner* — Gloria M Hale

(57) ABSTRACT

The brassiere with integrated holster is an item of underclothing. The brassiere with integrated holster is configured for use with one or more firearms. The brassiere with integrated holster is configured for use with one or more domestic articles. The brassiere with integrated holster is configured to store the one or more firearms. The brassiere with integrated holster is configured to store the one or more domestic articles. The brassiere with integrated holster comprises a brassiere and a plurality of pockets. The plurality of pockets are formed on the brassiere.

17 Claims, 4 Drawing Sheets

(56) References Cited

U.S. PATENT DOCUMENTS

| | | | | |
|---|---|---|---|---|
| 2013/0303052 | A1* | 11/2013 | Conrad | A41C 3/0057 450/89 |
| 2014/0374452 | A1* | 12/2014 | Hammers | F41C 33/048 224/243 |
| 2015/0296895 | A1* | 10/2015 | Muir | A41C 3/0035 450/89 |
| 2017/0301330 | A1* | 10/2017 | Fejzo | G10H 1/125 |
| 2019/0254358 | A1* | 8/2019 | Wittstadt | A41C 3/0035 |

* cited by examiner

BRASIERRE WITH INTEGRATED HOLSTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including wearing apparel, more specifically, a brassiere with a plurality of integrated pockets. (A41C3/0035)

SUMMARY OF INVENTION

The brassiere with integrated holster is an item of underclothing. The brassiere with integrated holster is configured for use with one or more firearms. The brassiere with integrated holster is configured for use with one or more domestic articles. The brassiere with integrated holster is configured to store the one or more firearms. The brassiere with integrated holster is configured to store the one or more domestic articles. The brassiere with integrated holster comprises a brassiere and a plurality of pockets. The plurality of pockets are formed on the brassiere.

These together with additional objects, features and advantages of the brassiere with integrated holster will be readily apparent to those of ordinary skill in the art upon reading the following detailed description of the presently preferred, but nonetheless illustrative, embodiments when taken in conjunction with the accompanying drawings.

In this respect, before explaining the current embodiments of the brassiere with integrated holster in detail, it is to be understood that the brassiere with integrated holster is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the brassiere with integrated holster.

It is therefore important that the claims be regarded as including such equivalent construction insofar as they do not depart from the spirit and scope of the brassiere with integrated holster. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
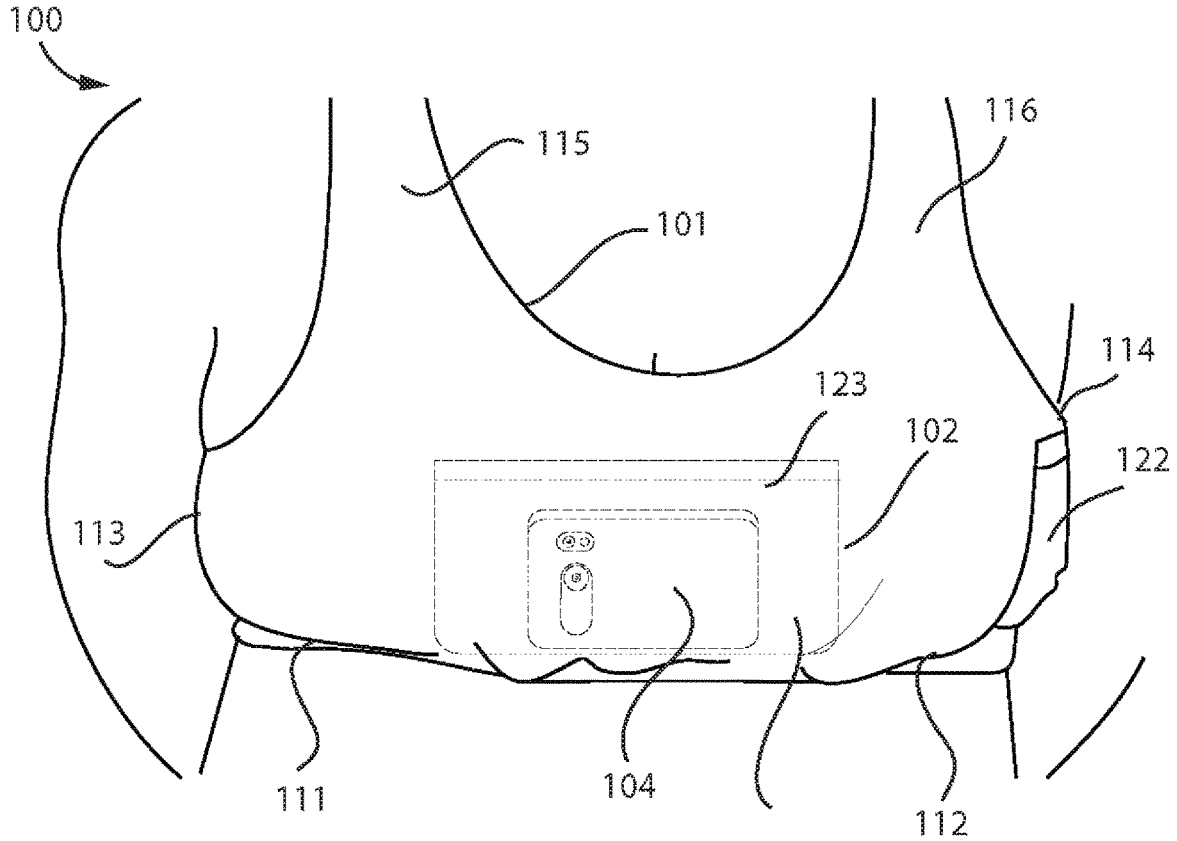
FIG. 1 is an in-use view of an embodiment of the disclosure.
Figure 2:
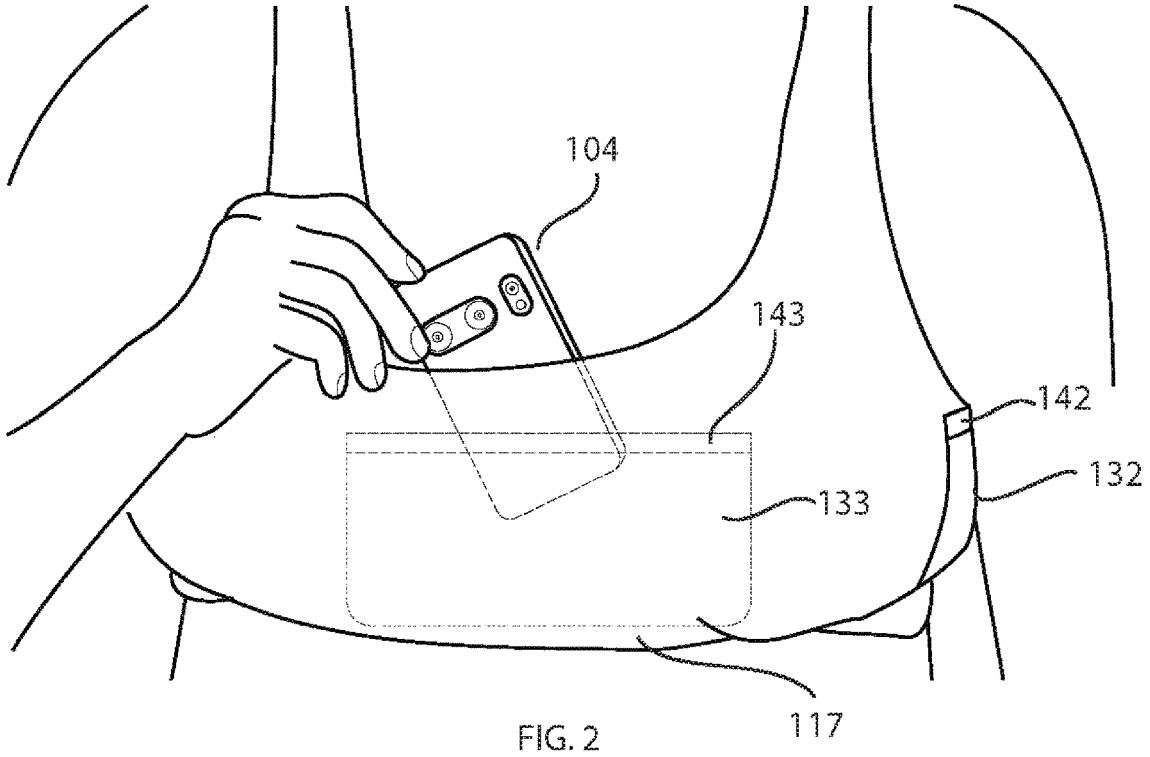
FIG. 2 is an in-use view of an embodiment of the disclosure.
Figure 3:
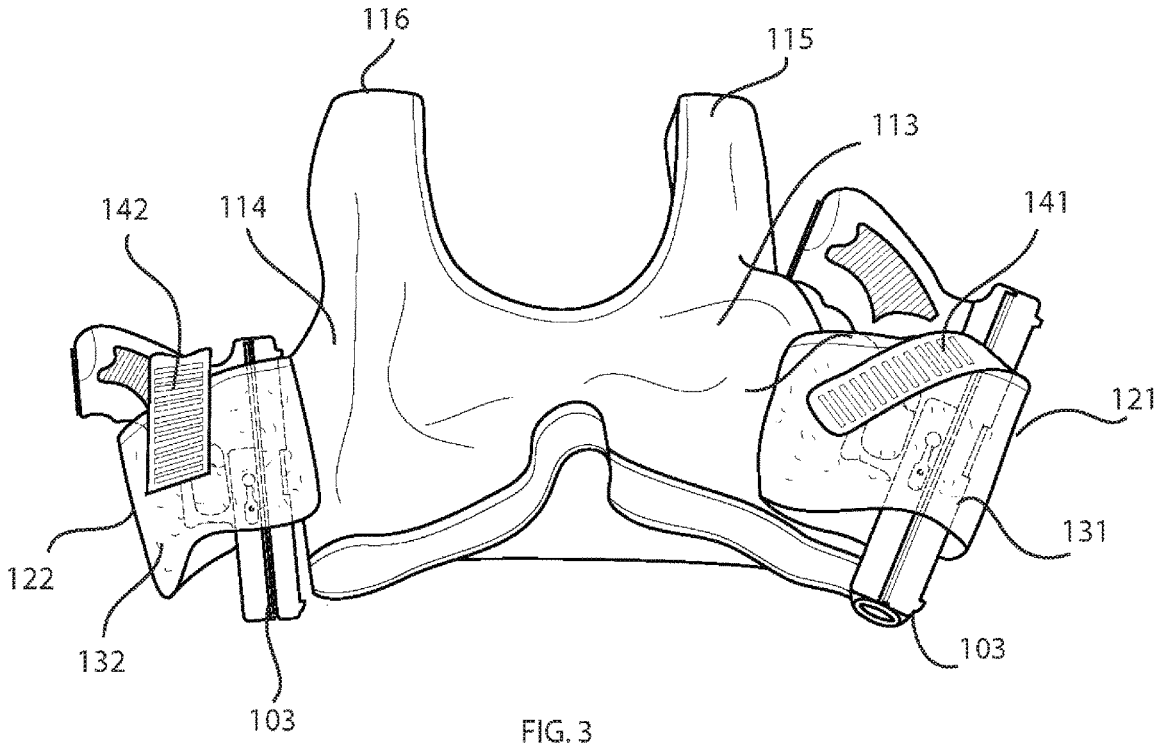
FIG. 3 is a rear view of an embodiment of the disclosure.
Figure 4:
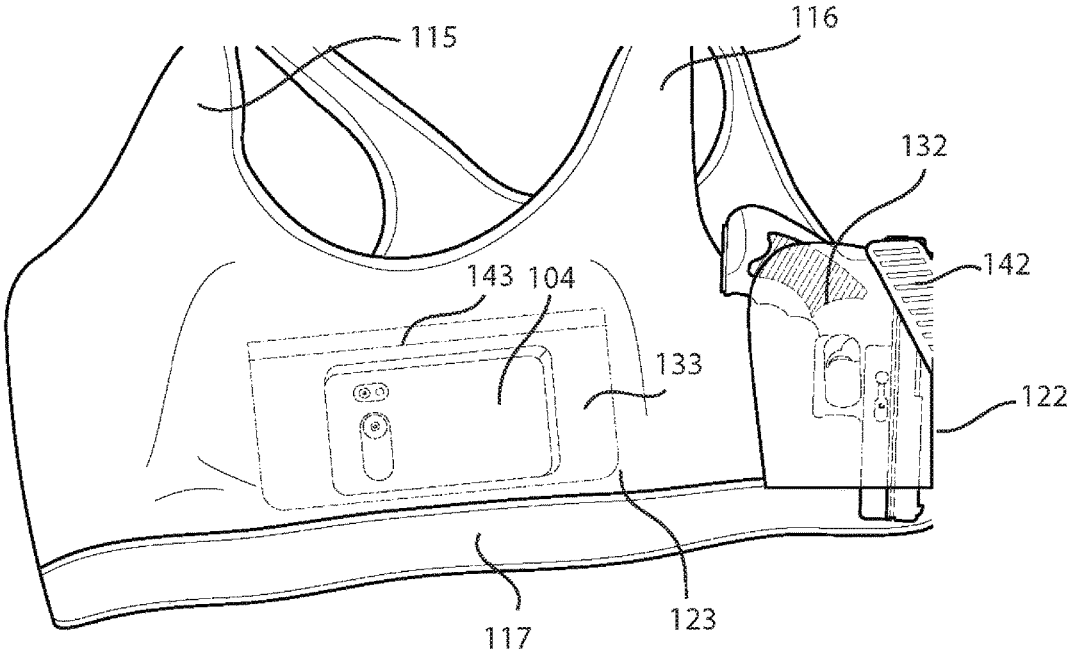
FIG. 4 is a front view of an embodiment of the disclosure.
Figure 5:
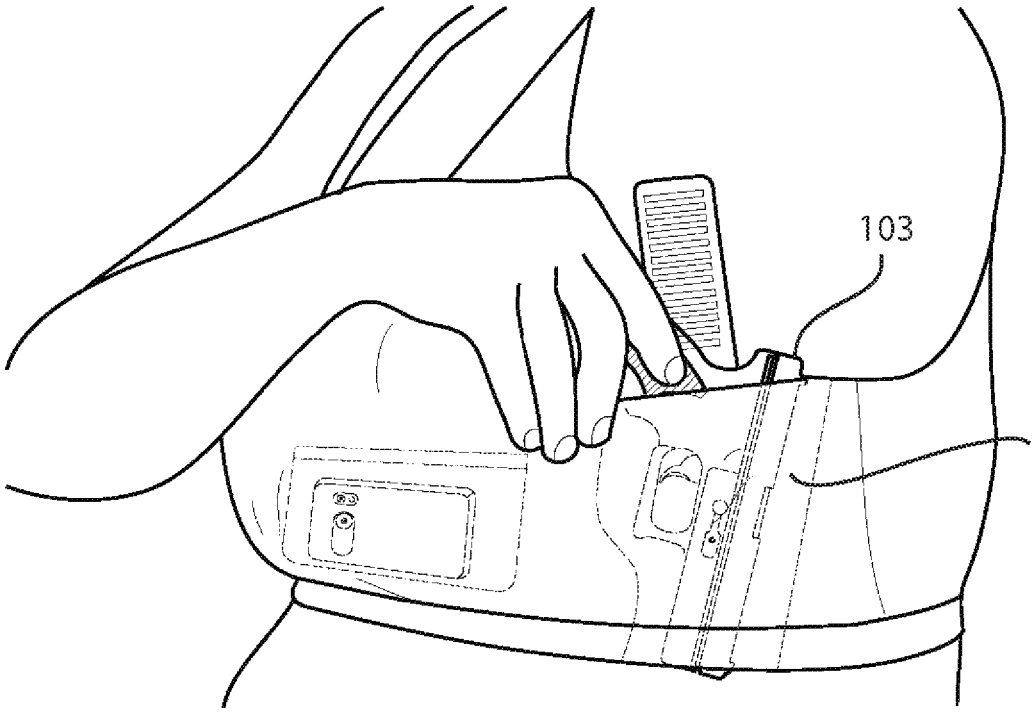
FIG. 5 is an in-use view of an embodiment of the disclosure.
Figure 6:
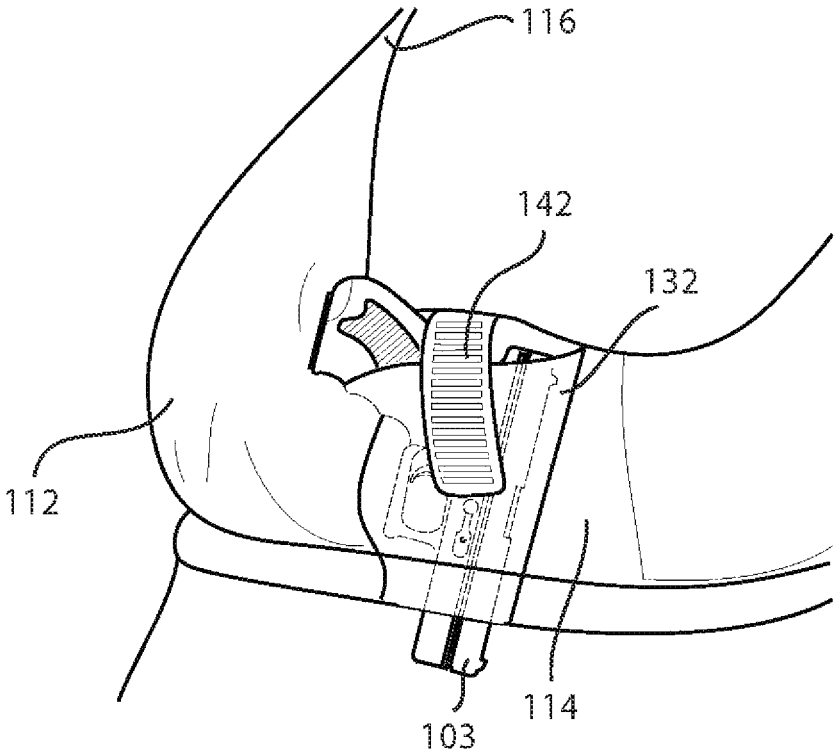
FIG. 6 is an in-use view of an embodiment of the disclosure.
Figure 7:
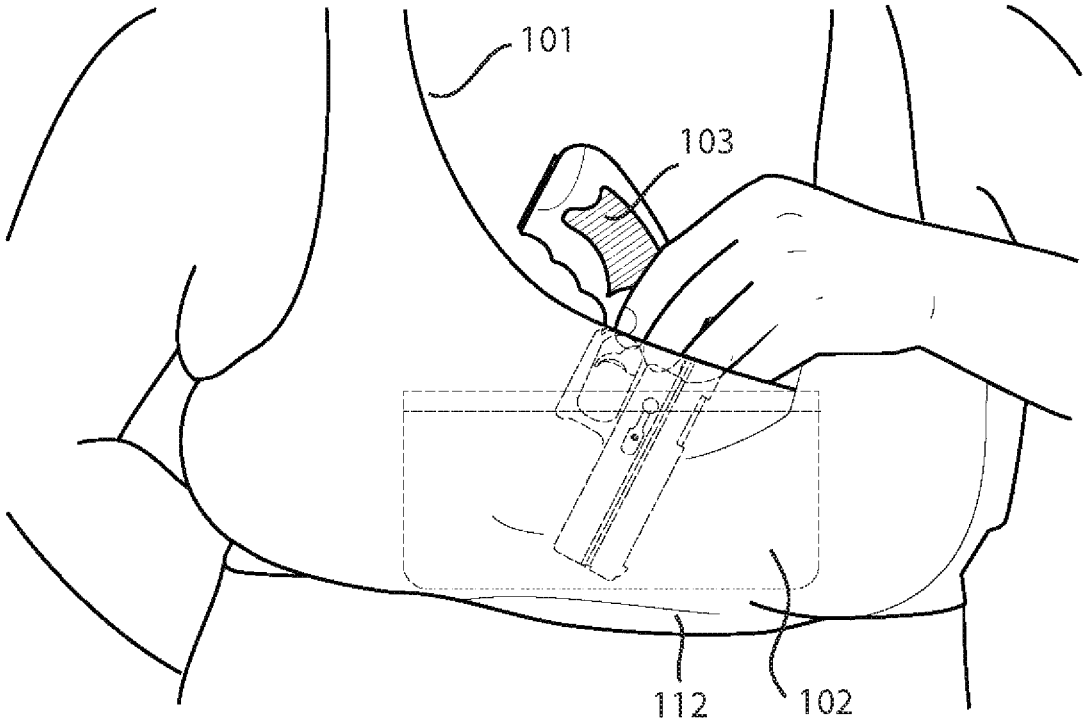
FIG. 7 is an in-use view of an embodiment of the disclosure.

Detailed reference will now be made to one or more potential embodiments of the disclosure, which are illustrated in FIGS. 1 through 7.

The brassiere with integrated holster 100 (hereinafter invention) is an item of underclothing. The invention 100 is configured for use with one or more firearms 103. The invention 100 is configured for use with one or more domestic articles 104. The invention 100 is configured to store the one or more firearms 103. The invention 100 is configured to store the one or more domestic articles 104. The invention 100 comprises a brassiere 101 and a plurality of pockets 102. The plurality of pockets 102 are formed on the brassiere 101. Each firearm contained in the one or more firearms 103 is defined in greater detail elsewhere in this disclosure. Each domestic article contained in the one or more domestic articles 104 is defined in greater detail elsewhere in this disclosure.

The brassiere 101 is an item of underclothing. The brassiere 101 is configured to cover the upper torso of a woman. The brassiere 101 is commonly considered to be a foundation garment. The design, assembly, and use of a brassiere 101 is well-known and documented in the textile and apparel arts. The brassiere 101 comprises a dexter cup 111, a sinister cup 112, a dexter wing 113, a sinister wing 114, a dexter strap 115, a sinister strap 116, and a bridge 117.

The dexter cup 111 is the structure of the brassiere 101 that supports the dexter breast of the woman wearing the brassiere 101. The sinister cup 112 is the structure of the brassiere 101 that supports the sinister breast of the woman wearing the brassiere 101. The dexter wing 113 is a textile structure that wraps around the dexter side of the torso of the woman wearing the brassiere 101. The sinister wing 114 is a textile structure that wraps around the sinister side of the torso of the woman wearing the brassiere 101. The bridge 117 is a textile structure that attaches the dexter cup 111 to the sinister cup 112.

The dexter strap 115 is an elastic webbing structure that supports the brassiere 101 from the dexter shoulder of the woman wearing the brassiere 101. The sinister strap 116 is an elastic webbing structure that supports the brassiere 101 from the sinister shoulder of the woman wearing the brassiere 101.

The design and use of the dexter cup 111, the sinister cup 112, the dexter wing 113, the sinister wing 114, the dexter strap 115, the sinister strap 116, and the bridge 117 in the manufacture of a brassiere 101 are well-known and documented in the textile and apparel arts.

Each of the plurality of pockets 102 is a storage space formed in the brassiere 101. Each of the plurality of pockets 102 is configured to store an object selected from the group consisting of a firearm selected from the one or more firearms 103 and a domestic article selected from the one or more domestic articles 104. The plurality of pockets 102 comprises a dexter holster 121, a sinister holster 122, and a front pocket 123.

The dexter holster 121 is a pocket selected from the plurality of pockets 102. The dexter holster 121 attaches to the exterior surface of the dexter wing 113 at the superior edge. The dexter holster 121 is configured to store a firearm selected from the one or more firearms 103. The dexter holster 121 comprises a dexter pouch 131 and a dexter fastener 141.

The dexter pouch 131 is the storage space formed by the dexter holster 121. The dexter pouch 131 is sized to receive a firearm selected from the one or more firearms 103. The dexter fastener 141 is a hook and loop fastener. The dexter fastener 141 attaches to the dexter pouch 131 such that the dexter fastener 141 securely closes the dexter pouch 131 around the selected firearm. Methods to attach the dexter pouch 131 to the dexter wing 113 are well-known and documented in the textile and apparel arts. Methods to attach the hook and loop fastener that forms the dexter fastener 141 to the dexter pouch 131 are well-known and documented in the textile and apparel arts.

The sinister holster 122 is a pocket selected from the plurality of pockets 102. The sinister holster 122 attaches to the exterior surface of the sinister wing 114 at the superior edge. The sinister holster 122 is configured to store a firearm selected from the one or more firearms 103. The sinister holster 122 comprises a sinister pouch 132 and a sinister fastener 142.

The sinister pouch 132 is the storage space formed by the sinister holster 122. The sinister pouch 132 is sized to receive a firearm selected from the one or more firearms 103. The sinister fastener 142 is a hook and loop fastener. The sinister fastener 142 attaches to the sinister pouch 132 such that the sinister fastener 142 securely closes the sinister pouch 132 around the selected firearm. Methods to attach the sinister pouch 132 to the sinister wing 114 are well-known and documented in the textile and apparel arts. Methods to attach the hook and loop fastener that forms the sinister fastener 142 to the sinister pouch 132 are well-known and documented in the textile and apparel arts.

The front pocket 123 is a pocket selected from the plurality of pockets 102. The front pocket 123 attaches to the anterior surface of the bridge 117. The front pocket 123 is configured to store a domestic article selected from the one or more domestic articles 104. The front pocket 123 comprises a front pouch 133 and a front fastener 143.

The front pouch 133 is the storage space formed by the front pocket 123. The front pouch 133 is sized to receive a domestic article selected from the one or more domestic articles 104. The front fastener 143 is a hook and loop fastener. The front fastener 143 attaches to the front pouch 133 such that the front fastener 143 securely closes the front pouch 133 around the selected domestic article. Methods to attach the front pouch wing 133 to the bridge 117 are well-known and documented in the textile and apparel arts. Methods to attach the hook and loop fastener that forms the front fastener 143 to the front pouch 133 are well-known and documented in the textile and apparel arts.

The following definitions were used in this disclosure:

Anterior: As used in this disclosure, anterior is a term that is used to refer to the front, or face side, of a human body. When comparing two objects, the anterior object is the object that is closer to front, or face side, of the human body.

Dexter: As used in this disclosure, dexter is a directional reference that refers to the right side of the body or the right side of an object from the perspective of a viewer who is facing the posterior side of the object.

Domestic Article: As used in this disclosure, a domestic article is an item or object: 1) that is commonly found within a household; or, 2) that is commonly carried or worn by a person. Examples of domestic articles include, but are not limited to, clothing, keys and key fobs, personal data devices, glasses, remote controls, or personal storage items such as purses, briefcases, wallets, or cases.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners.

Firearm: As used in this disclosure, a firearm is a handheld weapon designed to expel a projectile which has been accelerated using a mechanism comprising an explosion or an explosive decompression.

Foundation Garment: As used in this disclosure, a foundation garment is a garment used for managing the visible shape of a person.

Garment: As used in this disclosure, a garment is a textile-based structure that is used to cover an individual. Clothes, clothing, and apparel are synonyms for a garment.

Holster: As used in this disclosure, a holster is a storage pouch that attaches to a belt, webbing, sling, or luggage item. The holster is dedicated to containing a previously identified object such that the previously identified object is readily accessible.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Inferior: As used in this disclosure, inferior refers to a directional sense or location of the body. Specifically, inferior refers to an object or a side of an object that is proximal to the feet or distal from the head of the body.

Pocket: As used in this disclosure, a pocket is a small pouch or storage space that is formed into an object. Pockets are often formed by joining a second textile or a second sheeting to a first textile or a first sheeting, respectively, by sewing or heat sealing respectively. Methods to form pockets are well-known and documented in the textile and apparel arts.

Posterior: As used in this disclosure, posterior is a term that is used to refer to the side of a human body that is distal from the anterior side. When comparing two objects, the posterior object is the object that is distal from the anterior side of the human body.

Relaxed Shape: As used in this disclosure, a structure is considered to be in its relaxed state when no shear, strain, or torsional forces are being applied to the structure.

Sinister: As used in this disclosure, sinister is a directional reference that refers to the left side of the body or the left side of an object from the perspective of a viewer who is facing the posterior side of the object.

Superior: As used in this disclosure, superior refers to a directional sense or location of the body. Specifically, superior refers to an object or a side of an object that is distal from the feet or proximal to the head of the body.

Textile: As used in this disclosure, a textile is a material that is woven, knitted, braided or felted. Synonyms in common usage for this definition include fabric and cloth.

Underclothing: As used in this disclosure, underclothing refers to garments that are intended to be worn next to the skin. Underclothing is often worn in conjunction with an outer layer of clothing.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A foundation garment comprising:

a brassiere and a plurality of pockets;

wherein the plurality of pockets are formed on the brassiere;

wherein the foundation garment is configured for use with one or more firearms or one or more domestic articles;

wherein the foundation garment is configured to store the one or more firearms or one or more domestic articles;

wherein the brassiere is configured to cover an upper torso of a woman;

wherein the brassiere comprises a dexter cup, a sinister cup, a dexter wing, a sinister wing, a dexter strap, a sinister strap, and a bridge;

wherein the dexter cup is a structure of the brassiere that is adapted to support a dexter breast of the woman wearing the brassiere;

wherein the sinister cup is a structure of the brassiere that is adapted to support a sinister breast of the woman wearing the brassiere;

wherein the dexter wing is a textile structure that is adapted to wrap around a dexter side of the torso of the woman wearing the brassiere;

wherein the sinister wing is a textile structure that is adapted to wrap around a sinister side of the torso of the woman wearing the brassiere;

wherein the dexter strap is adapted to support the brassiere from a dexter shoulder of the woman wearing the brassiere;

wherein the sinister strap is adapted to support the brassiere from a sinister shoulder of the woman wearing the brassiere;

wherein the bridge is a textile structure that attaches the dexter cup to the sinister cup;

wherein the plurality of pockets comprises a dexter holster, a sinister holster, and a front pocket;

wherein the dexter holster attaches to an exterior surface of the dexter wing at a superior edge;

wherein the sinister holster attaches to an exterior surface of the sinister wing at a superior edge; and wherein the front pocket attaches to an anterior surface of the bridge.

2. The foundation garment according to claim 1 wherein each of the plurality of pockets is a storage space;

wherein each of the plurality of pockets is formed in the brassiere.

3. The foundation garment according to claim 2 wherein each of the plurality of pockets is configured to store an object selected from a group consisting of a firearm selected from the one or more firearms and a domestic article selected from the one or more domestic articles.

4. The foundation garment according to claim 3
wherein the dexter strap is an elastic webbing structure; and
wherein the sinister strap is an elastic webbing structure.

5. The foundation garment according to claim 4 wherein the dexter holster is configured to store a firearm selected from the one or more firearms.

6. The foundation garment according to claim 5 wherein the sinister holster is configured to store a firearm selected from the one or more firearms.

7. The foundation garment according to claim 6 wherein the front pocket is configured to store a domestic article selected from the one or more domestic articles.

8. The foundation garment according to claim 7
wherein the dexter holster comprises a dexter pouch and a dexter fastener;
wherein the dexter pouch is a storage space formed by the dexter holster;
wherein the dexter pouch is sized to receive the selected firearm;
wherein the dexter fastener is a hook and loop fastener; and
wherein the dexter fastener attaches to the dexter pouch such that the dexter fastener securely closes the dexter pouch around the selected firearm.

9. The foundation garment according to claim 8
wherein the sinister holster comprises a sinister pouch and a sinister fastener;
wherein the sinister pouch is a storage space formed by the sinister holster;
wherein the sinister pouch is sized to receive the selected firearm;
wherein the sinister fastener is a hook and loop fastener; and
wherein the sinister fastener attaches to the sinister pouch such that the sinister fastener securely closes the sinister pouch around the selected firearm.

10. The foundation garment according to claim 9
wherein the front pocket comprises a front pouch and a front fastener;
wherein the front pouch is the storage space formed by the front pocket;
wherein the front pouch is sized to receive a domestic article selected from the one or more domestic articles;
wherein the front fastener is a hook and loop fastener; and
wherein the front fastener attaches to the front pouch such that the front fastener securely closes the front pouch around the selected domestic article.

11. The foundation garment according to claim 4
wherein the plurality of pockets comprises a dexter holster;
wherein the dexter holster attaches to an exterior surface of the dexter wing at a superior edge; and
wherein the dexter holster is configured to store a firearm selected from the one or more firearms.

12. The foundation garment according to claim 11
wherein the dexter holster comprises a dexter pouch and a dexter fastener;
wherein the dexter pouch is a storage space formed by the dexter holster;
wherein the dexter pouch is sized to receive the selected firearm;
wherein the dexter fastener is a hook and loop fastener; and
wherein the dexter fastener attaches to the dexter pouch such that the dexter fastener securely closes the dexter pouch around the selected firearm.

13. The foundation garment according to claim 12
wherein the plurality of pockets further comprises a front pocket;
wherein the front pocket attaches to the anterior surface of the bridge; and
wherein the front pocket is configured to store a domestic article selected from the one or more domestic articles.

14. The foundation garment according to claim 13
wherein the front pocket comprises a front pouch and a front fastener;
wherein the front pouch is a storage space formed by the front pocket;
wherein the front pouch is sized to receive the domestic article selected from the one or more domestic articles;
wherein the front fastener is a hook and loop fastener; and
wherein the front fastener attaches to the front pouch such that the front fastener securely closes the front pouch around the selected domestic article.

15. The foundation garment according to claim 14
wherein the plurality of pockets further comprises a sinister holster; and
wherein the sinister holster attaches to an exterior surface of the sinister wing at a superior edge.

16. The foundation garment according to claim 15 wherein the sinister holster is configured to store a firearm selected from the one or more firearms.

17. The foundation garment according to claim 16
wherein the sinister holster comprises a sinister pouch and a sinister fastener;
wherein the sinister pouch is a storage space formed by the sinister holster;
wherein the sinister pouch is sized to receive the selected firearm;
wherein the sinister fastener is a hook and loop fastener; and
wherein the sinister fastener attaches to the sinister pouch such that the sinister fastener securely closes the sinister pouch around the selected firearm.

* * * * *